US010734173B2

(12) United States Patent
Glück et al.

(10) Patent No.: US 10,734,173 B2
(45) Date of Patent: Aug. 4, 2020

(54) SWITCHING DEVICE

(71) Applicant: RAFI GmbH & Co. KG, Berg (DE)

(72) Inventors: Peter Glück, Biberach (DE); Albert Wasmeier, Markdorf (DE); Karl Riedter, Baindt (DE); Manuel da Silva, Berg (DE)

(73) Assignee: RAFI GmbH & Co. KG (DE)

( * ) Notice: Subject to any disclaimer, the term of this patent is extended or adjusted under 35 U.S.C. 154(b) by 0 days.

(21) Appl. No.: 14/994,624

(22) Filed: Jan. 13, 2016

(65) Prior Publication Data

US 2016/0203925 A1 Jul. 14, 2016

(30) Foreign Application Priority Data

Jan. 14, 2015 (EP) ..... 15151138

(51) Int. Cl.

| | |
|---|---|
| ***H01H 13/14*** | (2006.01) |
| ***H01H 13/04*** | (2006.01) |
| ***H01H 13/48*** | (2006.01) |
| ***H01H 13/86*** | (2006.01) |

(52) U.S. Cl.

CPC ..... *H01H 13/14* (2013.01); *H01H 13/04* (2013.01); *H01H 13/48* (2013.01); *H01H 13/86* (2013.01)

(58) Field of Classification Search

CPC ..... H01H 13/14; H01H 13/04; H01H 13/48; H01H 13/86

USPC ..... 200/520, 5 A

See application file for complete search history.

(56) References Cited

U.S. PATENT DOCUMENTS

| | | | | |
|---|---|---|---|---|
| 3,711,668 | A | 1/1973 | Harnden, Jr. | |
| 4,412,113 | A * | 10/1983 | Mitsugi | H01H 13/48 200/242 |
| 4,803,321 | A | 2/1989 | Lefebvre | |
| 2010/0072046 | A1* | 3/2010 | Maeda | H01H 13/06 200/302.2 |
| 2010/0108486 | A1* | 5/2010 | Yoshida | H01H 13/85 200/520 |
| 2015/0235785 | A1* | 8/2015 | Koepsell | H01H 9/04 200/302.1 |

FOREIGN PATENT DOCUMENTS

| | | | |
|---|---|---|---|
| DE | 102009022687 | 7/2010 | |
| EP | 2645391 | * 10/2013 | H01H 13/06 |

* cited by examiner

*Primary Examiner* — Edwin A. Leon
*Assistant Examiner* — Iman Malakooti
(74) *Attorney, Agent, or Firm* — Pandiscio & Pandiscio

(57) ABSTRACT

In a switching device (1) for converting a mechanical movement into an electrical switching signal, comprising a housing (2) and an electrical switching element (3) that is connected to the housing (2) and can be moved relative to it, the switching device (1) should, firstly, occupy a significantly reduced space and, secondly, be manufactured exceedingly cost-effectively and can be connected to a circuit board (13) in a simple and straightforward manner without the circuit board (13) restricting or reducing the space available for the switching device (1). This task is accomplished in that the housing (2) and the switching element (3) enclose a space (5), that at least one switching contact (11) is provided in the base (6) of the housing (2) and that the particular switching contact (11) projects in the direction of the switching element (3) and beyond the outer contour of the base.

15 Claims, 7 Drawing Sheets

SWITCHING DEVICE

REFERENCE TO PENDING PRIOR PATENT APPLICATION

This patent application claims benefit of European Patent Application No. 15 151 138.3, filed Jan. 14, 2015, which patent application is hereby incorporated herein by reference.

FIELD OF THE INVENTION

The invention relates to a switching device in accordance with the precharacterising clause of patent claim 1.

BACKGROUND OF THE INVENTION

A switching device of this kind is disclosed in EP 2 645 391 A1, for example. This publication discloses a flexibly elastic and electrically conductive snap dome that is attached to a thin-walled body. The snap dome and the body are firmly mounted on the surface of a circuit board, on which at least one electrical switching contact is provided which projects from the circuit board in the direction of the snap dome.

When the snap dome is pushed through, a short circuit is created between the two switching contacts by means of which an electrical signal can be generated and converted into an electrical switching signal by means of an evaluation and control device.

Switching devices of this kind have proven themselves effective in practice, although they do suffer from the disadvantage that they can exclusively be used in electrical devices that occupy a correspondingly large space on the circuit board, since it is necessary for a switching device to be able to be installed. The switching device and the circuit board require a specified amount of space.

Moreover, attaching the body and the snap dome onto the circuit board often proves problematical, because switching devices of this kind should be used in environments in which there is contamination present in liquid or gaseous form which penetrates between the body and the circuit board in the direction of the switching contact, contaminating it, effecting a corrective influence or damaging it in other respects.

Moreover, manufacturing switching devices of this kind is exceedingly cost-intensive because it is necessary for there to be several stages of manufacture in order to produce the switching device and fix it to the circuit board.

SUMMARY OF THE INVENTION

It is therefore the task of the present invention to develop the switching device of the aforementioned kind such that, firstly, it occupies a significantly reduced space and, secondly, can be manufactured exceedingly cost-effectively and can be connected to a circuit board in a simple and straightforward manner without the circuit board restricting or reducing the space available for the switching device.

These purposes are achieved by the features that are listed in the characterising clause of patent claim 1.

Other advantageous further embodiments of the invention are disclosed in the subordinate claims.

The housing and the switching element enclose a space, at least one switching contact is provided in the base of the housing and the corresponding switching contact projects in the direction of the switching element and out of the external contour of the housing, as a result of which it is guaranteed that the switching contact is, firstly, provided with an airtight and/or watertight seal towards the outside and, secondly, that the spatial dimensions of the housing can be made sufficiently small so that it can also be used in components in which only a small spatial extent is available for such switching devices. The switching devices are used in locking systems, for example, in order to verify the key that has been inserted in the lock and to grant entitlement to open the door lock. Consequently, a large number of such switching devices are positioned in the locking system in such a way that the key exclusively actuates all of the switching devices simultaneously if it has the correct access entitlement to the lock.

The circuit board is positioned outside of the switching device, as a result of which it does not occupy any space there but can be installed in a different location from the switching device in question. The switching contacts that are cast or glued or otherwise attached into the housing are firmly secured on the housing and project both in the direction of the switching element and outwards, as a result of which they can be used as conductors in order to electrically evaluate the actuation of the switching element.

It is particularly advantageous for the switching element to be connected to the housing by means of flanging or ultrasonic welding, because, firstly, this secures the switching element firmly onto the housing and, secondly, the transitional areas between the switching element and the housing are provided with an airtight and/or watertight seal as a result of which the interior space enclosed by the snap dome and the housing is completely sealed.

BRIEF DESCRIPTION OF THE DRAWINGS

The drawing shows three sample embodiment of a switching device configured in accordance with the present invention, the details of which are explained below. In detail.

DETAILED DESCRIPTION OF THE INVENTION

Figure 1A:
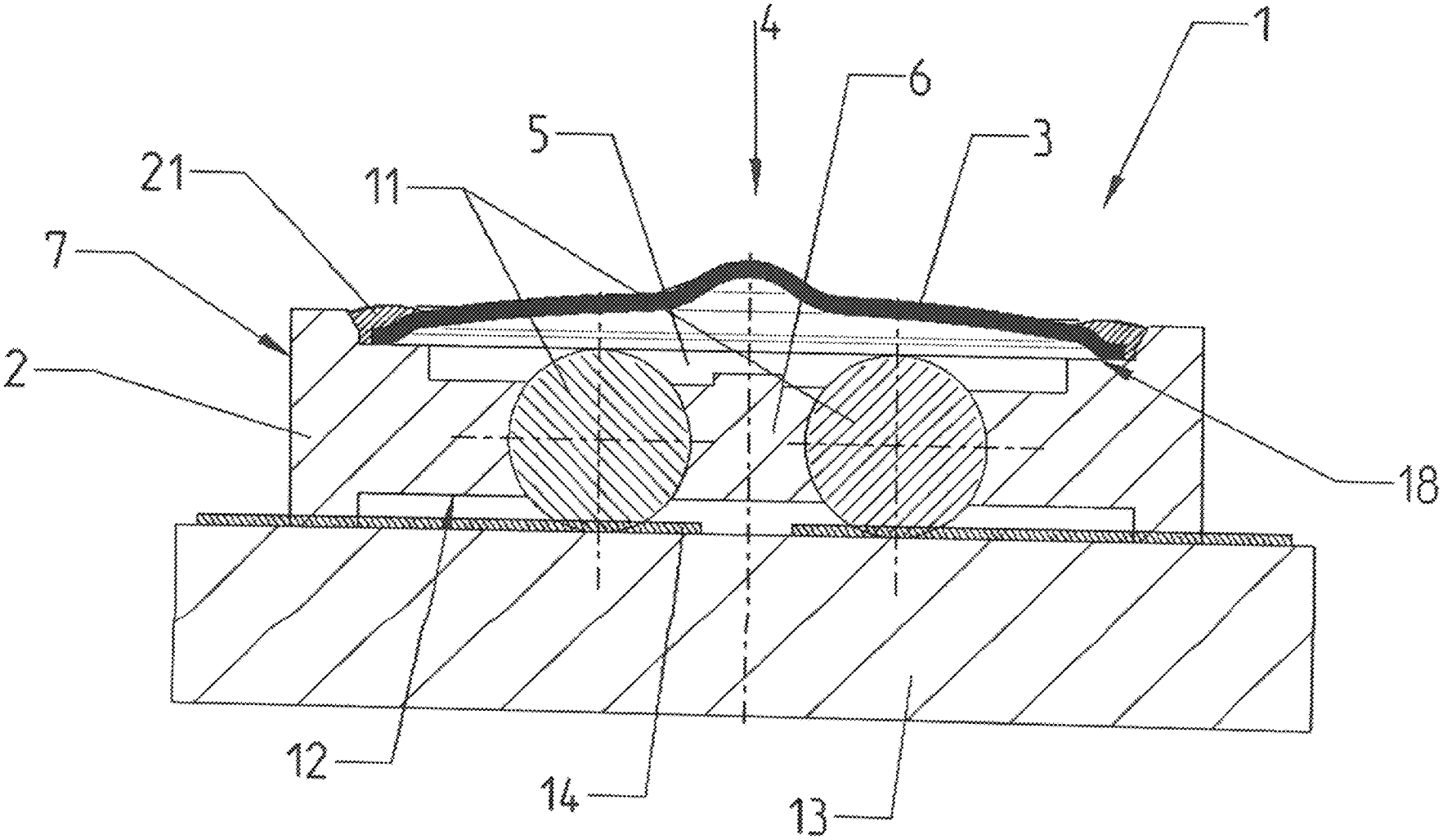
FIG. 1*a* shows a switching device with a switching element and a housing firmly connected to it in which two switching contacts are provided that are connected to a conductor path arranged adjacent to the housing, as a sectional view.
Figure 1B:
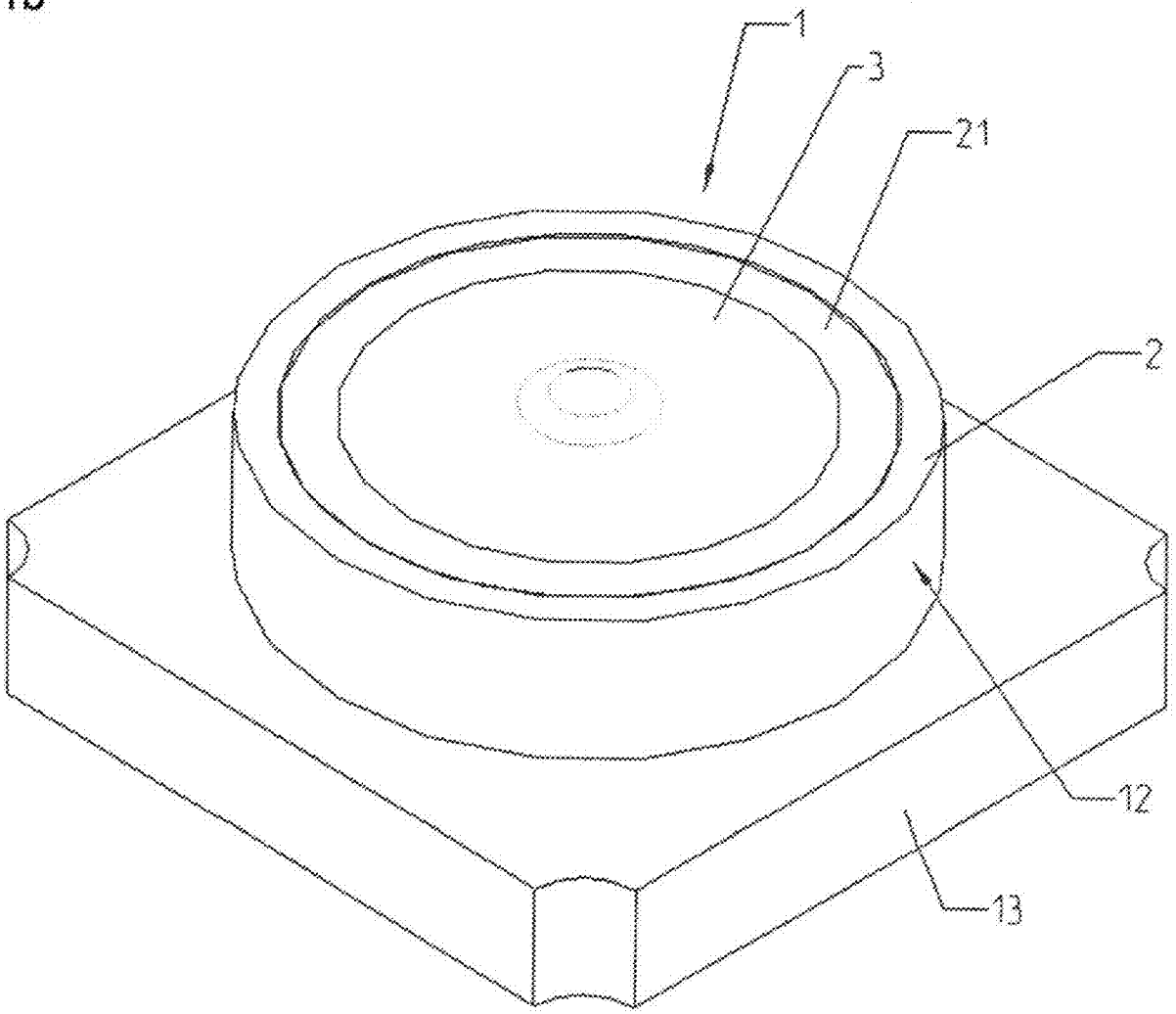
FIG. 1*b* shows the switching device in accordance with FIG. 1*a* as a perspective view from above.

FIGS. 1*a* and 1*b* show a switching device 1 by means of which a mechanically triggered movement is converted into an electrical switching signal, for example to control a machine tool or another electrical device. The switching device 1 can also be installed as a miniature component in a locking system or a lock of a door and be actuated by the projections on a key. The space available for the switching device 1 is extremely small in this case, as a result of which the switching device 1 as a miniature version has a spatial extent of 1 to 3 millimetres, or a diameter of approx. 3 millimetres.

The switching device 1 consists of a housing 2 manufactured from a dimensionally stable and temperature-resistant plastic material, and a switching element 3 that is firmly connected to it. The switching element 3 is either completely made from an electrically conductive material such as a metal, or is at least coated to a certain extent with an electrically conductive material. The switching element 3 is also referred to as a snap dome in the technical literature, because the switching element 3 is actuated in the direction of movement 4 from the initial position with an outward concave curvature which is transformed into a convex curvature when moved in the direction of a switching contact 11. The switching contact 11 is a fixed component of the housing 2 in this case.

The switching contact 11 can be configured as a ball or a cylindrically shaped, completely closed or tubular body. The switching contact 11 can also have a web, a groove or a comparable structure formed on it, creating a positive connection with the housing 2. It is a significant factor of the present invention that the switching contact in 11 is made of an electrically conductive material.

The switching contact 11 shown configured using two balls in the sample embodiments in FIGS. 1*a* and 1*b* is firmly embedded in the housing 2. During manufacture of the switching element 1, the switching contact 11 or the balls are embedded in the liquid plastic compound in such a way that the switching contact 11 configured as balls is jacketed in the area of the housing 2.

In this case, it is a technical necessity for the particular switching contact 11 to project both in the direction of the switching element 3 and also from the housing 2. The housing 2 has a flat base 6 from which the particular switching contact 11 projects.

The housing 2 and the switching element 3 form a completely airtight and/or watertight space 5 into which the particular switching contact 11 projects. When pressed through in the direction of movement 4 of the switching element 3, it comes into contact with both switching contacts 11, as a result of which an electrical short circuit is created thereby forming the electrical switching signal.

In order to connect the switching element 3 in a firm and airtight and/or watertight connection with the housing 2, an adhesive layer 21 is provided and the housing 2 has a wall 7 projecting at right angles from the base 12 with an L-shaped internal cross-sectional contour and a support surface for the switching element 3. The snap dome or the switching element 3 is positioned on the support surface between the inside of the wall 7. The adhesive layer 21 connects the switching element 3 in a firm and airtight and/or watertight connection to the housing 2, with the effect that the snap dome or the switching element 3 cannot be moved relative to the housing 2 in the area of the contact surface, but only the centre of the switching element 3 can be moved in the direction of the switching contacts 11.

The snap dome or the switching element 3 has a dome or a donor-shaped cross-sectional contour in its centre, as a result of which the stability of the switching element 3 is increased because the dome stiffens the thin-walled switching element 3 and can simultaneously be moved in the direction of the particular switching contact 11 in addition.

Figure 2A:
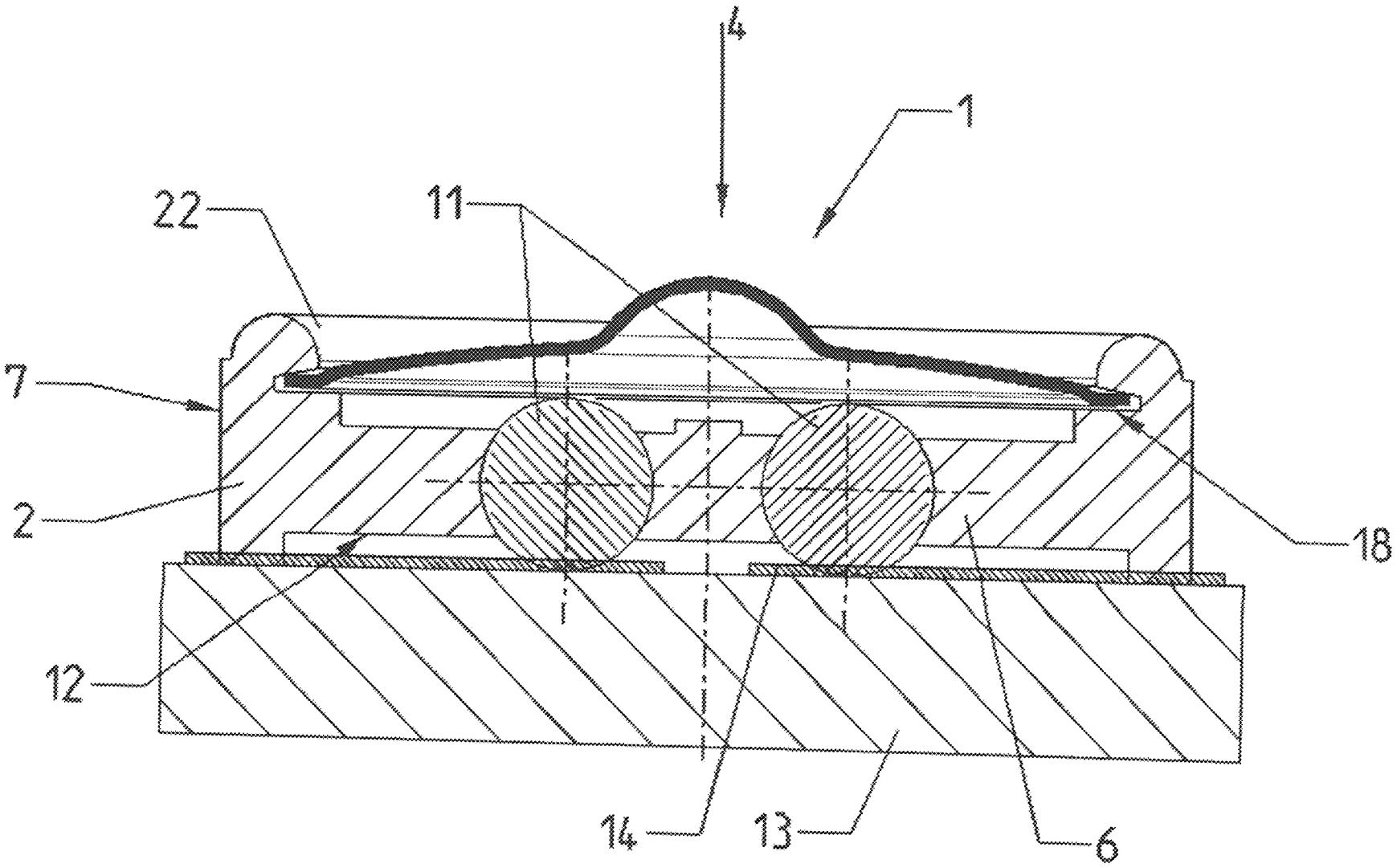
FIG. 2*a* shows the switching device in accordance with FIG. 1*a* in which the switching element is connected to the housing by ultrasonic welding.
Figure 2B:
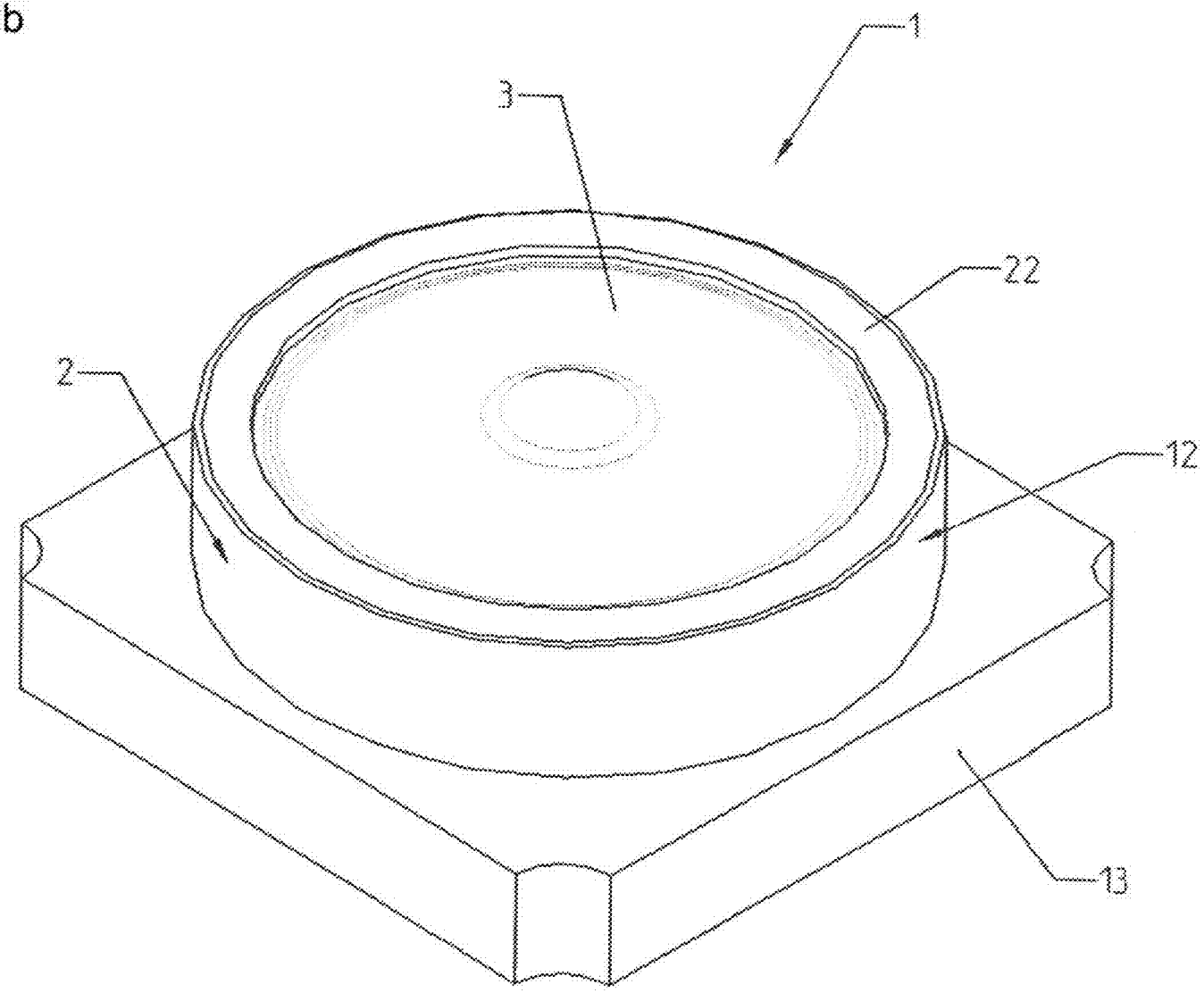
FIG. 2*b* shows the switching device in accordance with FIG. 2*a* as a perspective view from above.

FIGS. 2*a* and 2*b* show the adhesive layer 21 replaced by an ultrasonic flanging 22 creating a projection of the wall 7 that interacts in a positive and non-positive way with the switching element 3. A firm connection is created between the switching element 3 and the housing 2, and moreover the gap between the housing 2 or its wall 7 and the switching element 3 is sealed in such a way that neither water nor gas particles can penetrate the space 5.

Both configuration variants shown in FIG. 1*a*, 1*b* or 2*a* and 2*b* share the common feature that the particular switching element 3 is freely accessible from the outside. Both the adhesive layer 21 and also the ultrasonic flanging 22 run in a ring shape around the outside area of the particular switching element 3.

Figure 3:
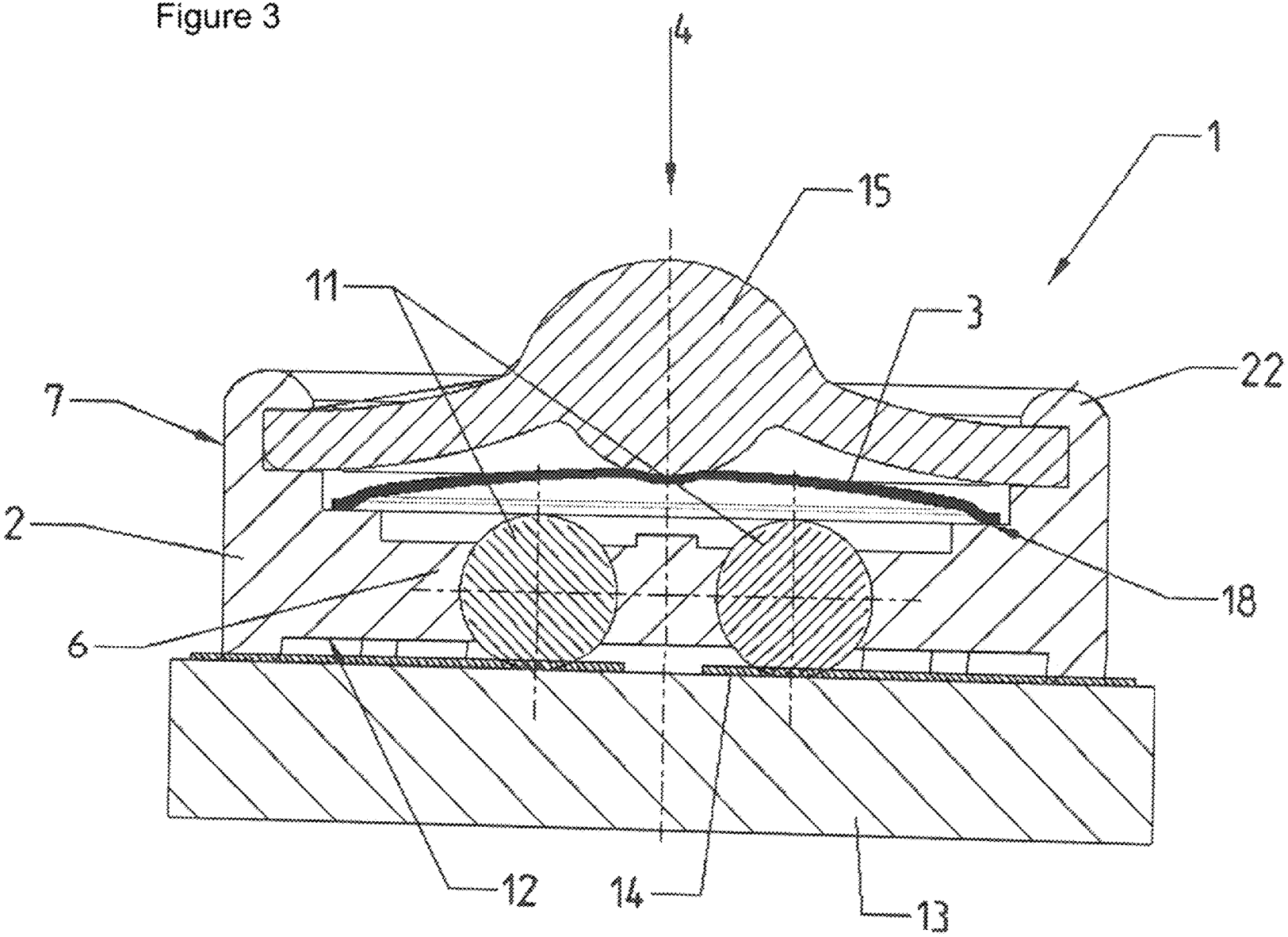
FIG. 3 shows a second sample embodiment of the switching device in accordance with FIG. 1*a* with an actuation element additionally attached to the housing.

FIG. 3 shows that the corresponding snap dome or switching element 3 is completely covered by an actuation element 15. The actuation element 15 lies on the switching element 3 in the initial position of the latter, and has an outward facing shape. When the actuation element 15 is pressed in the direction of movement 4, this means both the actuation element 15 and the switching element 3 are moved in the direction of the particular switching contacts 11.

An electrical impulse is generated for example by actuation of the switching element 3 in the direction of movement 4 and an electrical connection between two adjacent switching contacts 11. The pulse is absorbed by the switching contacts 11 and by means of a circuit board 13 on which a plurality of conductor pathways 14 is arranged, for example in the shape of a grid, and is then transferred to an evaluation and control device such as a microprocessor in the usual technical manner.

Figure 4:
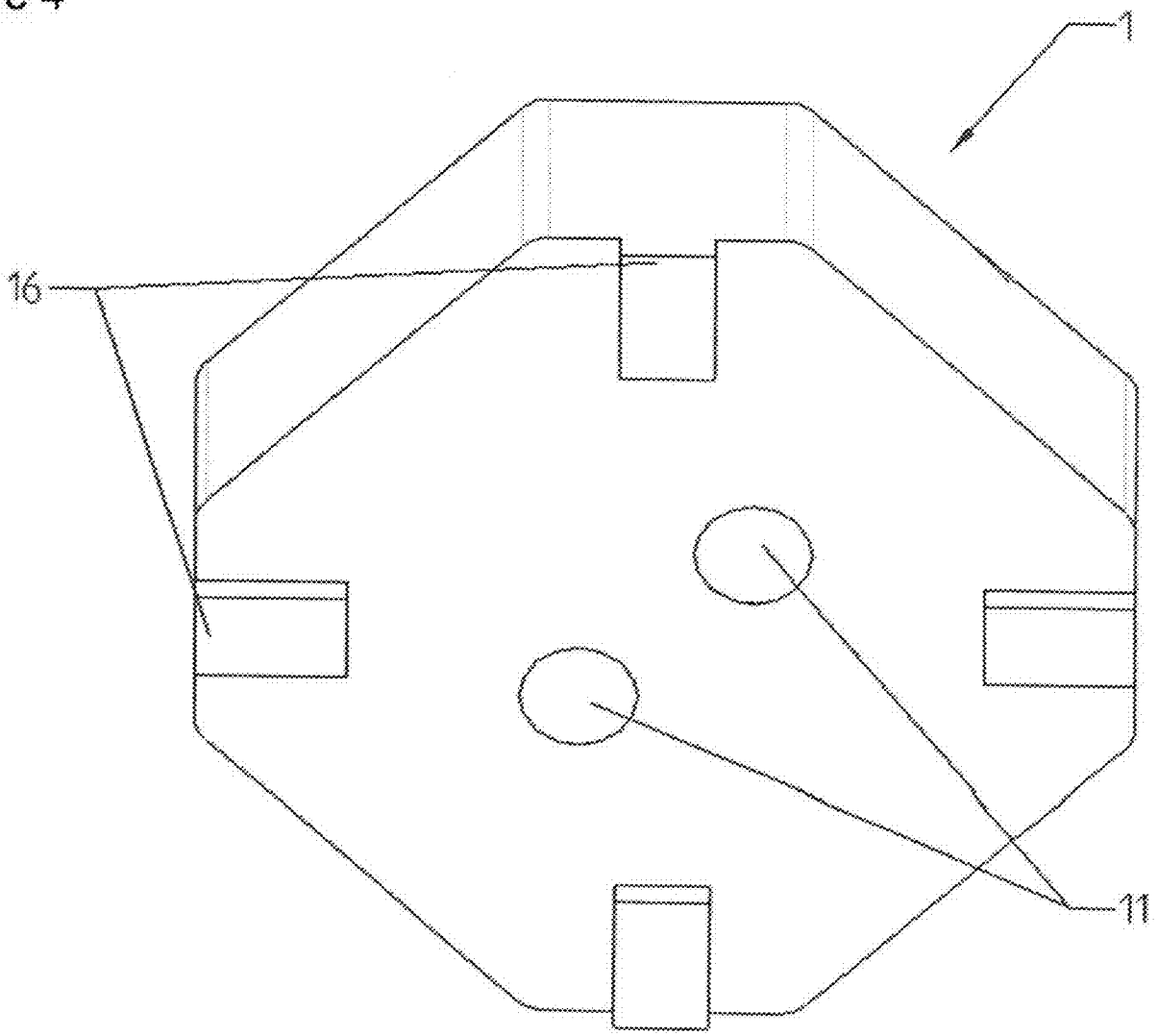
FIG. 4 shows the housing in accordance with FIGS. 1*a* and 2*a*, from below, on which four attachment feet are provided

FIG. 4 shows that four feet 16 are formed onto the base 6 on the side of the switching device 1 facing towards the circuit board 13. The particular switching device 1 can be firmly connected to the circuit board 13 by means of these feet 16. The particular foot 16 can be connected with the circuit boards 13 by means of a weld, a soldered connection, a glued connection, a clip-on connection or a screw connection, with the effect that firm locking is achieved between the housing 2 of the switching device 1 and the circuit board.

Figure 5:
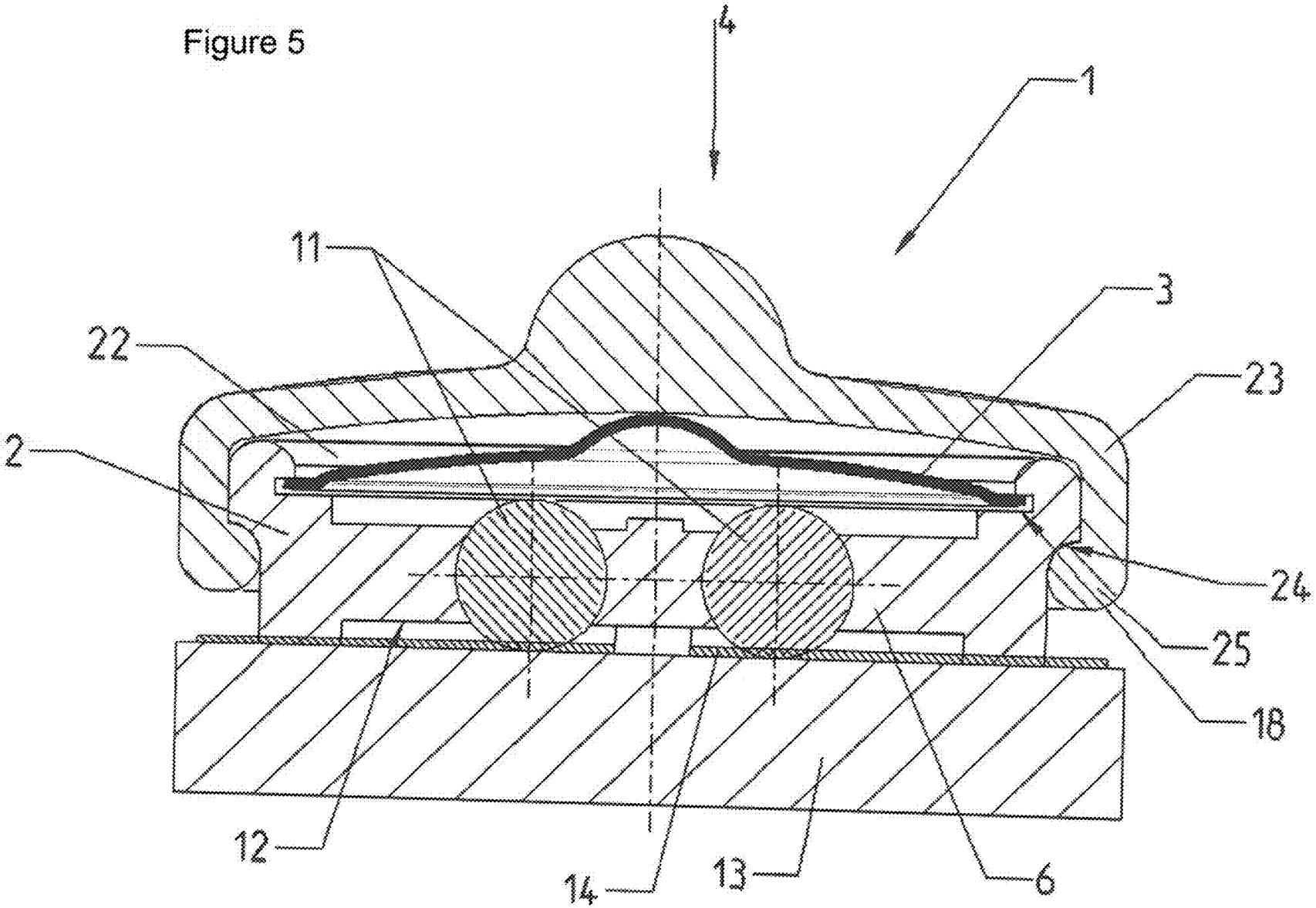
FIG. 5 shows a third sample embodiment of the switching device in accordance with FIG. 1*a* with an actuation element in the form of a cap additionally pushed over the housing.

FIG. 5 shows that the particular snap dome or the switching element 3 is completely covered by a cap 23. The cap 23 wholly or partially encloses the wall 7 and a fixing ring 25 is formed onto the side of the cap 23 facing the wall 7 in such a way that the fixing ring 25 engages in a shoulder 24 in the wall 7 in the manner of an undercut. The cap 23 is thus clipped onto the switching device 1 by the fixing ring 25 in an airtight and liquid-tight connection. In the initial position of the switching element 3, the cap 23 lies on the switching element 3. The cap 23 is made of a deformable and flexible material, with the effect that both the cap 23 and also the switching element 3 are moved in the direction of the particular switching contacts 11 when the cap 23 is actuated in the direction of movement 4.

The contour of the fixing ring 25 is adapted in an advantageous manner to the contour of the shoulder 24 of the wall 7, and in the assembled condition of the switching device 1 it forms a kind of undercut. The contour of the fixing ring 25 or the shoulder 24 can have different shapes. Also, the shoulder 24 can be formed as a circumferential groove or a web projecting from the wall 7.

The number of feet 16 can be configured as required, and Beefeater 16 can also take the form of circular segments or a continuous ring in order to connect them to the circuit board 13.

What is claimed is:

1. A switching device (1) for converting a mechanical movement into an electrical switching signal, comprising a housing (2) and an electrical switching element (3) that is connected to the housing (2) and can be moved relative to it, characterised in that, the housing (2) and the switching element (3) enclose a space (5), wherein at least two switching contacts (11) are provided in a base (6) of the housing (2), and that the switching contacts (11) project into the space (5) in the direction of the switching element (3) and out of the base (6) in the direction that faces away from the switching element (3);

wherein the switching element (3) comprises a bottom surface facing the space (5), wherein at least a portion of the bottom surface of the switching element (3) is electrically conductive, and further wherein the portion of the bottom surface of the switching element (3) that is electrically conductive does not extend beyond the space (5); and wherein the switching element (3) is mounted to the housing (2) by an adhesive layer (21) disposed around the perimeter of the switching element (3) so as to contact the switching element (3) and the housing, whereby to create a watertight seal between the switching element (3) and the housing (2), such that space (5) is a sealed, watertight cavity.

2. The switching device (1) in accordance with claim 1, characterised in that, the switching contacts (11) are configured as a ball or a cylindrically shaped conductor made of an electrically conductive material.

3. The switching device (1) in accordance with claim 1, characterised in that, the switching contacts (11) are embedded in the base (6) of the housing (2) and are firmly connected to the base (6) of the housing (2).

4. The switching device (1) in accordance with claim 3, characterised in that, the switching contacts (11) are inserted into a passage opening worked into the base (6) of the housing (2), and are glued into this passage opening.

5. The switching device (1) in accordance with claim 3, characterised in that, the switching contacts (11) are connected to the housing (2) during manufacture of the base (6) in the injection moulding process.

6. The switching device (1) in accordance with claim 1, characterised in that, at least one foot (16) is provided on the base (6) and at a distance from it, in which case the foot (16) can be connected to an external component, preferably a circuit board (13).

7. The switching device (1) in accordance with claim 6, characterised in that, the foot (16) is connected to the external components, and that the material of the housing (2) is made of a temperature-resistant and dimensionally stable substance.

8. The switching device (1) in accordance with claim 1, characterised in that, the switching element (3) is connected by means of a glued connection (21) or ultrasonic flanging (22).

9. The switching device (1) in accordance with claim 8, characterised in that, the glued connection (21) or the ultrasonic flanging (22) has a ring shape, and that the switching element (3) can be freely accessed from outside.

10. The switching device (1) in accordance with claim 1, characterised in that, the switching element (3) is configured as a snap dome with an additional dome pointing upwards.

11. The switching device (1) in accordance with claim 1, characterised in that, the switching element (3) has at least one zone with a concave curvature towards the outside which can be bent elastically when the switching element (3) is actuated in the direction of the particular switching contact (11).

12. The switching device (1) in accordance with claim 1, characterised in that, a pressure piece is attached to the housing (2) which is arranged adjacent to the particular switching element (3), by means of which the switching element (3) can be activated when the pressure piece is advanced axially.

13. The switching device (1) in accordance with claim 1, characterised in that, the housing (2) has external dimensions in the range between one and three millimetres in diameter or an edge length from one to three millimetres.

14. The switching device (1) in accordance with claim 1, characterised in that, an actuating element (15) or a cap (23) is firmly arranged on the side of the switching element (3) facing away from the housing (2), and transfers a movement of the actuating element in a movement direction (4) onto the switching element (3).

15. The switching device (1) in accordance with claim 14, characterised in that, the actuating element (15) or the cap (23) partially or entirely encloses a wall (7) of the switching device (1), that a shoulder (24) is formed onto the wall (7) and a fixing ring (25) is formed onto the side of the actuating element (15) or the cap (23) facing away from the wall (7), and that the shoulder (24) and the fixing ring (25) make a clip-on connection in the form of an undercut in the assembled condition, in such a way that the actuating element (15) or the cap (23) is held in a positional orientation on the switching device (1).

* * * * *